US005989490A

United States Patent [19]

Pinnow et al.

[11] Patent Number: 5,989,490

[45] Date of Patent: Nov. 23, 1999

[54] WEAR RESISTANT, POWDER METALLURGY COLD WORK TOOL STEEL ARTICLES HAVING HIGH IMPACT TOUGHNESS AND A METHOD FOR PRODUCING THE SAME

[75] Inventors: Kenneth E. Pinnow, Pittsburgh; William Stasko, West Homestead, both of Pa.

[73] Assignee: Crucible Materials Corporation, Syracuse, N.Y.

[21] Appl. No.: 09/103,570

[22] Filed: Jun. 24, 1998

Related U.S. Application Data

[62] Division of application No. 08/826,393, Apr. 9, 1997, Pat. No. 5,830,287.

[51] Int. Cl.[6] ..... B22F 3/15

[52] U.S. Cl. ..... 419/11; 419/49

[58] Field of Search ..... 419/11, 28, 29, 419/49

[56] References Cited

U.S. PATENT DOCUMENTS

| | | | |
|---|---|---|---|
| 2,949,356 | 8/1960 | Hughes et al. . | |
| 3,219,442 | 11/1965 | Johnstin . | |
| 4,249,945 | 2/1981 | Haswell et al. | 75/241 |
| 4,863,515 | 9/1989 | Roberts et al. | 75/238 |
| 5,238,482 | 8/1993 | Stasko et al. | 75/338 |
| 5,344,477 | 9/1994 | Stasko et al. | 75/255 |
| 5,589,011 | 12/1996 | Gonsalves | 148/334 |

FOREIGN PATENT DOCUMENTS

| | | |
|---|---|---|
| 0 275 475 A1 | 7/1988 | European Pat. Off. . |

*Primary Examiner*—Ngoclan Mai
*Attorney, Agent, or Firm*—Finnegan, Henderson Farabow, Garrett & Dunner, L.L.P.

[57] ABSTRACT

A hot-worked, fully dense, wear resistant, vanadium-rich, powder metallurgy cold work tool steel article having improved impact toughness. This is achieved by controlling the amount, composition and size of the primary carbides and by insuring that substantially all the primary carbides remaining after hardening and tempering are MC-type vanadium-rich carbides. The article is produced by hot isostatic compacting of nitrogen atomized powder particles.

3 Claims, 2 Drawing Sheets

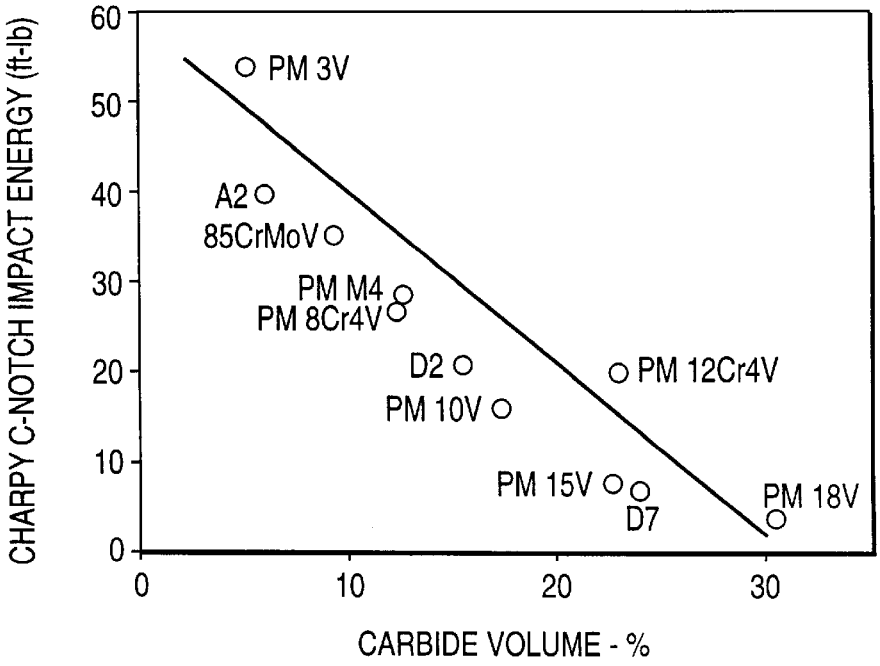
FIG. 3
FIG. 4
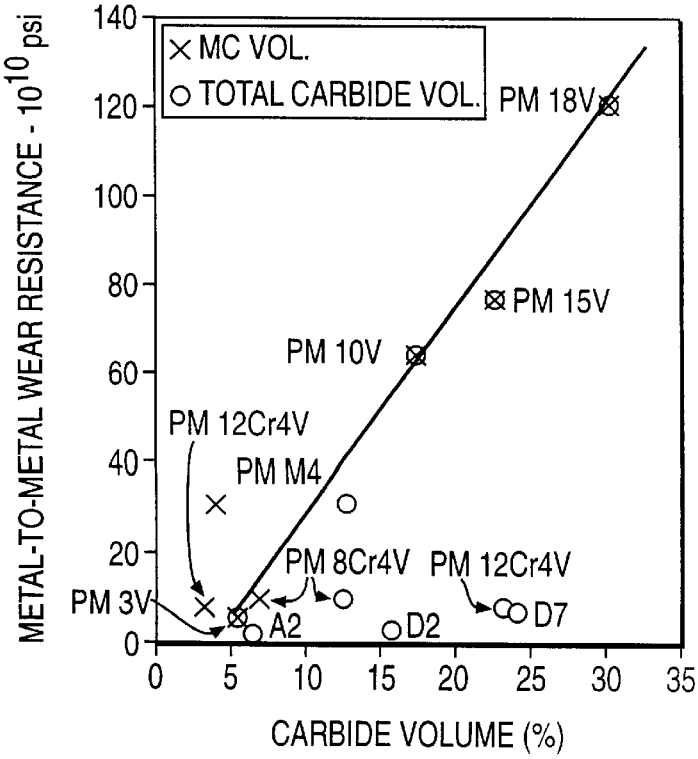

WEAR RESISTANT, POWDER METALLURGY COLD WORK TOOL STEEL ARTICLES HAVING HIGH IMPACT TOUGHNESS AND A METHOD FOR PRODUCING THE SAME

This is a division of application Ser. No. 08/826,393, filed Apr. 9, 1997, U.S. Pat. No. 5,820,287, the specification of which which is incorporated herein by reference.

DESCRIPTION OF THE INVENTION

1. Field of the Invention

The invention relates to wear resistant, powder metallurgy cold work tool steel articles and to a method for their production by compaction of nitrogen atomized, prealloyed powder particles. The articles are characterized by very high impact toughness, which in combination with their good wear resistance, makes them particularly useful in punches, dies, and other metalworking tools requiring these properties.

2. Background of the Invention

Tool performance is a complex issue depending on many different factors such as the design and manufacture of the tooling, the presence or absence of an effective surface treatment or coating, the actual operating conditions, and ultimately the base properties of the tool materials. In cold work applications, the wear resistance, toughness, and strength of the tool material are generally the most important factors affecting service life, even where coatings or surface treatments are employed. In many applications, wear resistance is the property which controls service life, whereas in others a combination of good wear resistance and very high toughness is required for optimum performance.

The metallurgical factors controlling the wear resistance, toughness, and strength of cold work tool steels are fairly well understood. For example, increasing the heat treated hardness of any tool steel will increase wear resistance and compressive strength. For a given hardness level, however, different tool steels can exhibit vastly different impact toughness and wear resistance depending on the composition, size, and the amount of primary (undissolved) carbides in their microstructure. High carbon, alloyed tool steels, depending on the amounts of chromium, tungsten, molybdenum, and vanadium that they contain, will form $M_7C_3$, $M_6C$, and/or MC-type primary carbides in their microstructure. The vanadium-rich MC-type carbide is the hardest and therefore most wear resistant of the primary carbides usually found in highly alloyed tool steels, followed in decreasing order of hardness or wear resistance by the tungsten and molybdenum-rich carbides ($M_6C$-type) and the chromium-rich carbides ($M_7C_3$-type). For this reason, alloying with vanadium to form primary MC-type carbides for increased wear resistance has been practiced in both conventional (ingot cast) and powder metallurgical tool steels for many years.

The toughness of tool steels is largely dependent on the hardness and composition of the matrix as well as on the amount, size, and distribution of the primary carbides in the microstructure. In this regard, the impact toughness of conventional (ingot-cast) tool steels is generally lower than that of powder metallurgically produced (PM) steels of similar composition, because of the large primary carbides and heavily segregated microstructures that the ingot-cast tool steels often contain. Consequently, a number of high performance, vanadium-rich, cold work tool steels have been produced by the powder metallurgy process including the PM 8Cr4V steels disclosed in U.S. Pat. No. 4,863,515, the PM 5Cr10V steels disclosed in U.S. Pat. No. 4,249,945, and the PM 5Cr15V steels disclosed in U.S. Pat. No. 5,344,477. However, in spite of the great improvements in wear resistance or in toughness or in both of these properties offered by these PM steels, none of them offer the combination of very high toughness and good wear resistance needed in many cutting, blanking, and punching applications.

In work to further improve the toughness of cold work tool steels, it has been discovered in accordance with the invention, that a remarkable improvement in the impact toughness of wear resistant, vanadium-containing, powder metallurgical cold work steels can be achieved by restricting the amount of primary carbide present in their microstructure and by controlling their composition and processing such that type vanadium-rich carbides are essentially the only primary carbides remaining in the microstructure after hardening and tempering. The notable improvement in toughness obtained with the articles of the invention is based on the findings that the impact toughness of powder metallurgy cold work tool steels at a given hardness decreases as the total amount of primary carbide increases, essentially independent of carbide type, and that by controlling composition and processing so that substantially all the primary carbides present are MC-type vanadium-rich carbides, the amount of primary carbide needed to achieve a given level of wear resistance can be minimized. It has also been discovered that in comparison to conventional ingot-cast tool steels with compositions similar to those of the articles of the invention, that production of the articles by hot isostatic compaction of nitrogen atomized, prealloyed powder particles produces a significant change in the composition as well as in the size and distribution of the primary carbides. The former effect is a hereto unknown benefit of powder metallurgical processing for cold work tool steels, and is highly important in the articles of the invention because it maximizes the formation of primary MC-type vanadium-rich carbides and largely eliminates the formation of softer $M_7C_3$ carbides, which in addition to MC-type carbides are present in greater amounts in ingot-cast tool steels of similar composition.

It is accordingly a primary object of the invention to provide wear resistant, vanadium-containing, powder metallurgy cold work tool steel articles and a method for the production of these articles, with substantially improved impact toughness.

This is achieved by closely controlling the composition and processing of these articles to control the amount, composition, and size of the primary carbides in these materials and to assure that substantially all the primary carbides remaining in these articles after hardening and tempering are MC-type vanadium-rich carbides.

SUMMARY OF THE INVENTION

In accordance with the invention, there is provided a hot worked, fully dense, wear resistant, vanadium-rich, powder metallurgy, cold work tool steel article having high impact toughness and which is produced from nitrogen atomized, prealloyed powders. The steel composition limits are 0.60 to 0.95%, preferably 0.70 to 0.90 carbon; 0.10 to 2.0%, preferably 0.2 to 1.0%, manganese; up to 0.10%, preferably up to 0.05%, phosphorus; up to 0.15%, preferably up to 0.03%, sulfur; 2% maximum, preferably 1.5% maximum, silicon; 6 to 9%, preferably 7 to 8.5%, chromium; up to 3%, preferably 0.5 to 1.75%, molybdenum; up to 1%, preferably up to 0.5%, tungsten; 2 to 3.20%, preferably 2.25 to 2.90%, vanadium; up to 0.15%, preferably up to 0.10%, nitrogen; and balance iron and incidental impurities. The article, if hardened and tempered to a hardness of at least 58 HRC, has a dispersion of substantially all MC-type carbides within the range of 4 to 8 percent by volume with the maximum size of the MC-type carbides not exceeding about six microns in their longest dimension.

The maximum carbon content does not exceed the amount given by the formula:

$$\% C_{maximum}=0.60+1.77(\% V-1.0).$$

The article exhibits a Charpy C-notch impact strength exceeding 50 ft-lb.

In accordance with the method of the invention, the articles thereof within the composition limits set forth above are produced by nitrogen gas atomizing a molten tool steel alloy at a temperature of 2800 to 3000° F., preferably 2850 to 2950° F., rapidly cooling the resultant powder to ambient temperature, screening the powder to about −16 mesh (U.S. standard), hot isostatically compacting the powder at a temperature between 2000 and 2150° F. at a pressure between 13 to 16 ksi, whereby the resulting articles after hot working, annealing, then hardening to at least 58 HRC, have a dispersion of substantially all MC-type vanadium-rich primary carbides in the range of about 4 to 8 percent by volume and where the maximum sizes of the primary carbides do not exceed about six microns in their largest dimension and whereby a C-notch impact strength of at least 50 ft-lb, as defined herein, is achieved.

It is essential in regard to the articles of the invention that their chemical composition be maintained within the broad and preferred ranges given below. Within these ranges it may be advantageous to further balance the composition to avoid the formation of ferrite and unduly large amounts of retained austenite during hardening and tempering. Further, it is important that the composition be balanced such that substantially all the primary carbides remaining in the microstructure of the articles after hardening and tempering are vanadium-rich MC-type carbides. For this reason, the maximum amounts of carbon must be balanced with the vanadium contents of articles by the following formula:

$$(\% C)_{maximum} = 0.60 + 0.177(\% V - 1.0)$$

| Element | Broad Range | Preferred Range |
|---|---|---|
| Carbon* | 0.60–0.95 | 0.70–0.90 |
| Manganese | 0.1–2.0 | 0.2–1.00 |
| Phosphorus | 0.10 max | 0.05 max |
| Sulfur | 0.15 max | 0.03 max |
| Silicon | 2.0 max | 1.50 max |
| Chromium | 6.00–9.00 | 7.00–8.50 |
| Molybdenum | 3.00 max | 0.50–1.75 |
| Tungsten | 1.00 max | 0.50 max |
| Vanadium | 2.00–3.20 | 2.25–2.90 |
| Nitrogen | 0.15 max | 0.10 max |
| Iron | Balance | Balance |

*$(\% C)_{maximum} = 0.60 + 0.177(\%V - 1.0)$

Use of carbon in amounts greater than that permitted by this relationship reduces the toughness of the articles of the invention, largely by changing the compositions and increasing the amounts of primary carbide remaining in the microstructure after hardening and tempering. Sufficient carbon must be present, however, to combine with vanadium to form the hard wear resistant carbides and also to increase the hardness of the tool steel matrix to the levels necessary to avoid excessive deformation and wear in service. The alloying effects of nitrogen in the articles of the invention are somewhat similar to those of carbon. Nitrogen increases the hardness of martensite and can form hard nitrides and carbonitrides with carbon, chromium, molybdenum, and vanadium which can improve wear resistance. However, nitrogen is not as effective for this purpose as carbon in vanadium-rich steels, because the hardness of vanadium nitride or carbonitride is significantly less than that of vanadium carbide. For this reason, nitrogen is best limited in the articles of the invention to not more than about 0.15% or to the residual amounts introduced during melting and nitrogen atomizing of the powders from which the articles of the invention are made.

It is also essential in accordance with the invention to control the amounts of chromium, molybdenum, and vanadium within the above ranges to obtain the desired combination of high toughness and wear resistance, along with adequate hardenability, tempering resistance, machinability, and grindability.

Vanadium is very important for increasing wear resistance through the formation of MC-type vanadium-rich carbides or carbonitrides. Smaller amounts of vanadium below the indicated minimum do not provide for sufficient carbide formation, whereas amounts larger than the indicated maximum produce excessive amounts of carbides which can lower toughness below the desired level. Combined with molybdenum, vanadium is also needed for improving the tempering resistance of the articles of the invention.

Manganese is present to improve hardenability and is useful for controlling the negative effects of sulfur on hot workability through the formation of manganese-rich sulfides. However, excessive amounts of manganese can produce unduly large amounts of retained austenite during heat treatment and increases the difficulty of annealing the articles of the invention to the low hardnesses needed for good machinability.

Silicon is useful for improving the heat treating characteristics of the articles of the invention. However, excessive amounts of silicon decrease toughness and unduly increase the amount of carbon or nitrogen needed to prevent the formation of ferrite in the microstructure of the powder metallurgical articles of the invention.

Chromium is very important for increasing the hardenability and tempering resistance of the articles of the invention. However, excessive amounts of chromium favor the formation of ferrite during heat treatment and promote the formation of primary chromium-rich $M_7C_3$ carbides which are harmful to the combination of good wear resistance and toughness afforded by the articles of the invention.

Molybdenum, like chromium, is very useful for increasing the hardenability and tempering resistance of the articles of the invention. However, excessive amounts of molybdenum reduce hot workability and increase the volume fraction of primary carbide to unacceptable levels. As is well known, tungsten may be substituted for a portion of the molybdenum in a 2:1 ratio, for example in an amount up to about 1% Sulfur is useful in amounts up to 0.15% for improving machinability and grindability through the formation of manganese sulfide. However, in applications where toughness is paramount, it is preferably kept to a maximum of 0.03% or lower.

The alloys used to produce the nitrogen atomized, vanadium-rich, prealloyed powders used in making the articles of the invention may be melted by a variety of methods, but most preferably are melted by air or vacuum induction melting techniques.

The temperatures used in melting and atomizing the alloys, and the temperatures used hot isostatically pressing the powders must be closely controlled to obtain the small carbide sizes necessary to achieve the high toughness and grindability needed by the articles of the invention.

powder metallurgy wear resistant alloys were obtained and tested for comparison. The chemical compositions of these commercial alloys are also given in Table I. Nominal chemical compositions are given for those commercial alloys for which actual chemical compositions were not available.

TABLE 1

Compositions of Experimental Materials

| Material | Bar No. | Atomization Temp. ° F. | C | Mn | P | S | Si | Cr | V | W | Mo | N | O |
|---|---|---|---|---|---|---|---|---|---|---|---|---|---|
| Experimental PM Cold Work Tool Steels | | | | | | | | | | | | | |
| PM 3V*** | 96–280 | — | 0.84 | 0.34 | 0.009 | 0.016 | 0.90 | 7.49 | 2.61 | — | 1.37 | 0.043 | 0.016 |
| PM 3V*** | 96–267 | — | 0.84 | 0.40 | 0.010 | 0.016 | 0.93 | 7.53 | 2.61 | — | 1.39 | 0.048 | 0.012 |
| PM 3V*** | 90–80* | 2910 | 0.81 | 0.36 | 0.01 | 0.003 | 0.91 | 7.40 | 2.82 | — | 0.96 | 0.045 | 0.0065 |
| PM 110CrVMo | 91–65* | 2860 | 1.14 | 0.47 | 0.012 | 0.005 | 1.10 | 7.39 | 2.53 | 1.10 | 1.56 | 0.045 | 0.0075 |
| Commercial PM Cold Work Tool Steels | | | | | | | | | | | | | |
| PM 8Cr4V | 89–19 | — | 1.47 | 0.36 | 0.02 | 0.027 | 0.96 | 8.02 | 4.48 | — | 1.50 | 0.10 | 0.007 |
| PM M4 | 92–73 | — | 1.43 | 0.70 | 0.021 | 0.24 | 0.56 | 3.82 | 3.92 | 5.37 | 5.10 | 0.034 | 0.014 |
| PM 12Cr4V | 90–136 | — | 2.28 | 0.30 | 0.019 | 0.018 | 0.36 | 12.50 | 4.60 | 0.17 | 1.10 | 0.067 | — |
| PM 10V | 95–154 | — | 2.45 | 0.52 | 0.018 | 0.058 | 0.90 | 5.22 | 9.57 | 0.04 | 1.27 | 0.05 | 0.016 |
| PM 15V | 89–169 | — | 3.55 | 1.11 | — | 0.013 | 0.69 | 4.64 | 15.21 | — | 1.29 | 0.04 | — |
| PM 18V | 89–182 | — | 3.98 | 0.60 | — | 0.013 | 1.32 | 4.85 | 17.32 | — | 1.36 | 0.044 | — |
| Commercial Ingot-Cast Cold Work Tool Steels | | | | | | | | | | | | | |
| A-2** | — | — | 1.00 | 0.70 | — | — | 0.30 | 5.25 | 0.30 | — | 1.15 | — | — |
| D-2** | — | — | 1.55 | 0.35 | — | — | 0.45 | 11.50 | 0.90 | — | 0.80 | — | — |
| 85CrVMo | 85–65 | — | 0.82 | 0.38 | 0.02 | 0.004 | 1.08 | 7.53 | 2.63 | 0.12 | 1.55 | 0.026 | 0.003 |
| 110CrVMo | 85–66 | — | 1.12 | 0.30 | 0.02 | 0.004 | 1.05 | 7.48 | 2.69 | 1.14 | 1.69 | 0.040 | 0.002 |
| D-7 | 75–36 | — | 2.35 | 0.34 | 0.02 | 0.005 | 0.32 | 12.75 | 4.43 | 0.26 | 1.18 | 0.037 | 0.0034 |

*Laboratory produced material
**Nominal chemical composition
***Invention Steels

BRIEF DESCRIPTION OF THE DRAWINGS

FIG. 3 is a graph showing the effect of primary carbide content on the impact toughness of hardened and tempered, vanadium-rich, powder metallurgical cold work tool steels at a hardness of 60–62 HRC. (Longitudinal test direction.)

FIG. 4 is a graph showing the effect of the amounts of primary vanadium-rich MC-type carbide on the metal to metal wear resistance of hardened and tempered, vanadium rich, powder metallurgy cold work tool steels at a hardness of 60–62 HRC.

DESCRIPTION OF THE PREFERRED EMBODIMENTS

To demonstrate the principles of the invention, a series of experimental powder metallurgical alloys were laboratory produced by nitrogen atomization of induction melted materials. The chemical compositions, in percent by weight, and the atomizing temperatures where available for these alloys are given in Table 1. Also, several commercial ingot-cast and The laboratory alloys in Table I were processed by (1) screening the prealloyed powders to −16 mesh size (U.S. standard), (2) loading the screened powder into five-inch diameter by six-inch high mild steel containers, (3) vacuum outgassing the containers at 500° F., (4) sealing the containers, (5) heating the containers to 2065° F. for four hours in a high pressure autoclave operating at about 15 ksi, and (6) then slowly cooling them to room temperature. All the compacts were readily hot forged to bars using a reheating temperature of 2050° F. The hot reduction of the forged bars ranged from about 70 to 95 percent. Test specimens were machined from the bars after they had been annealed using a conventional tool steel annealing cycle, which consisted of heating at 1650° F. for 2 hours, slowly cooling to 1200° F. at a rate not to exceed 25® F. per hour, and then air cooling to ambient temperature.

Several examinations and tests were conducted to demonstrate the advantages of the PM tool steel articles of the invention and the criticality of their compositions and methods of production. Specifically, tests and examinations were made to evaluate their (1) microstructure, (2) hardness in the heat treated condition, (3) Charpy C-notch impact strength, (4) and metal to metal wear resistance in a crossed-cylinder wear test. Most of the materials for the toughness and wear tests were hardened and tempered to an aim hardness of 60–62 HRC. This was done to eliminate hardness as a test variable and to reflect a hardness typical of many cold work tool applications.

Microstructure

As indicated earlier herein, the wear resistance and impact toughness of the powder metallurgical tool steel articles of the invention as well as those of other tool steel articles are highly dependent on the amount, type, size, and distribution of the primary carbides in their microstructure. In this respect, there are important differences between the characteristics of the primary carbides in the PM articles of the invention and those in other powder metallurgy or conventional ingot-cast cold work tool steel articles.

Figure 1:
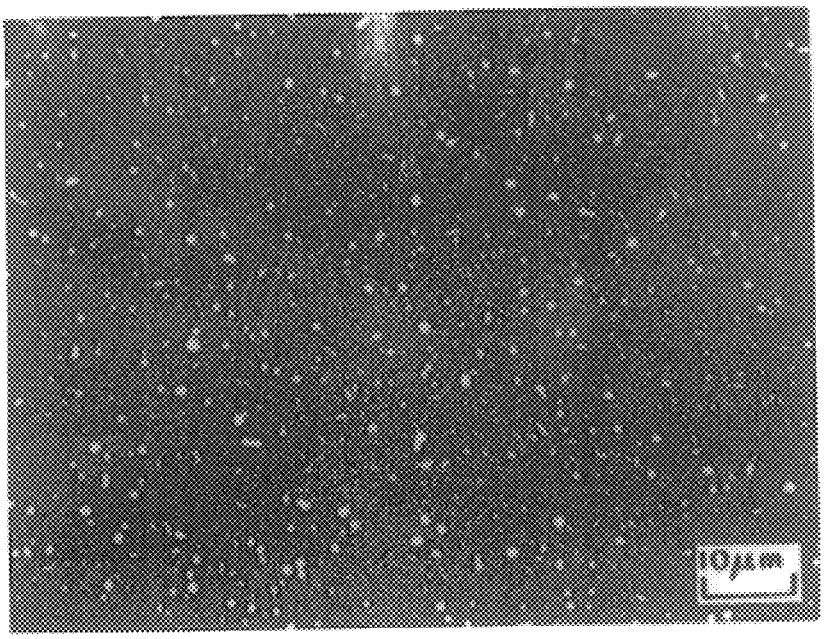
FIG. 1 is a light photomicrograph showing the distribution and size of the primary MC-type vanadium-rich carbides in a hardened and tempered, vanadium-rich, particle metallurgy tool steel article of the invention containing 2.82% vanadium (Bar 90-80).
Figure 2:
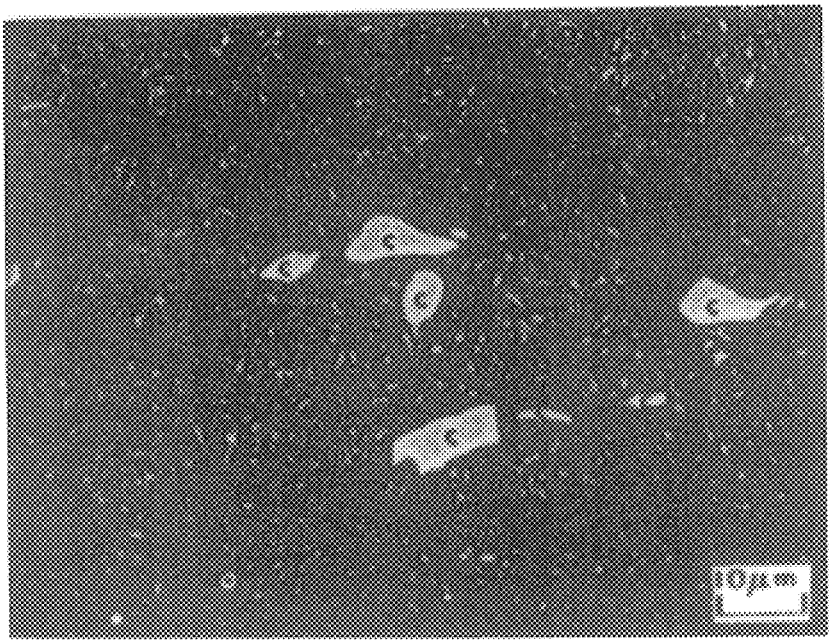
FIG. 2 is a light photomicrograph showing the distribution and size of the primary vanadium-rich MC-type and chromium-rich $M_7C_3$-type carbides in a conventional ingot-cast tool steel (85CrVMo) having a composition similar to that of Bar 90-80.

Some of the important differences between the primary carbides present in a hardened and tempered PM article of the invention (Bar 90-80) and those in a hardened and tempered conventional ingot-cast tool steel article of similar composition (Bar 85-65) are shown in the light photomicrographs given in FIGS. 1 and 2. To emphasize the differences between the primary carbides in these photomicrographs, they were made to appear as white particles on a dark background by use of a special etching technique. In FIG. 1, it can be seen that the primary carbides in Bar 90-80 are generally well below six microns and substantially all below four microns in size and evenly distributed throughout the matrix. X-ray dispersive analysis of the primary carbides in this PM tool steel article indicates that they are essentially all vanadium-rich MC-type carbides, in accord with the teaching of the invention. FIG. 2 shows the irregular size and distribution of the primary carbides in Bar 85-65. X-ray dispersive analysis of the primary carbides in this steel indicates the many but not all of the very large angular carbides are $M_7C_3$-type chromium-rich carbides, whereas most of the smaller, better distributed primary carbides are MC-type vanadium-rich carbides similar to those present in Bar 90-80. These observations support the finding that the powder metallurgical methods used for the articles of the invention make for important differences in the type and composition as well as in the size and distribution of the primary carbides.

Table II summarizes the results of scanning electron microscope (SEM) and image analyzer examinations conducted on several of the PM tool steels and on one of the ingot-cast tool steels (85CrMoV) listed in Table I. As can be seen, the total volume percent of primary carbide measured for these steels ranges from approximately 5% in PM 3V (Bar 90-80) to 30% in PM 18V (Bar 89-192). The type of primary carbide present (MC, $M_7C_3$, and $M_6C$) varies according to processing and the alloying balance, with only PM 3V (Bar 90-80), PM 10V (Bar 95-154), PM 15V (Bar 89-169), PM 18V (Bar 89-182), having substantially all MC-type carbides.

The important differences made by relatively small differences in carbon or in carbon and alloy content on the amount and type of primary carbides in the powder metallurgy steels can be seen by comparing the results for PM 3V (Bar 90-80) which contains about 5.1 volume percent of MC-type carbide and whose composition falls within the scope of the claims, PM 110CrMoV (Bar 91-65) which contains about 3.4 volume percent MC-type carbide and 5.9 volume percent $M_7C_3$-type carbide and which contains about one percent tungsten and slightly more carbon than Bar 90-80, and PM 8Cr4V (Bar 89-19) which contains about 6.6 volume percent MC-type carbide and 5.7% $M_7C_3$-type carbide and which contains considerably more carbon and vanadium than Bar 90-80. The effects of powder metallurgy processing versus ingot-casting can be seen by comparing the results for PM 3V (Bar 90-80) which contains about 5.1 volume percent MC-type carbide and for 85CrMoV (Bar 85-65) which is an ingot-cast material of about the same composition as Bar 90-80, but which contains about 2.8 volume percent MC-type carbide and 1.7 volume percent $M_7C_3$ carbide.

TABLE II

Relationship Between the Amount and Type of Primary Carbides and the Properties of the Experimental and Commercial Cold Work Tool Steels

| Material | Bar No. | Heat Treatment | Hardness | Volume % MC | $M_2C_3$ | $M_6C$ | Total | Crossed Cylinder Wear Resistance $10^{10}$ psi | Charpy C-Notch* Impact Energy (ft-lb) |
|---|---|---|---|---|---|---|---|---|---|
| | | Experimental PM Cold Work Tool Steels | | | | | | | |
| PM 3V | 96–280 | 2050° F./30 min, AC, 975 F./2 + 2 + 2 hr | 58 | — | — | — | — | — | 89 |
| PM 3V | 96–267 | 2050° F./30 min, AC, 975 F./2 + 2 + 2 hr | 58 | — | — | — | — | — | 78 |
| PM 3V | 90–80** | 2050° F./30 min, AC, 975 F./2 + 2 + 2 hr | 60 | 5.1 | — | — | 5.1 | 6 | 54 |
| PM 110CrVMo | 91–65 | 1950° F./45 min, AC, 1000 F./2 + 2 + 2 hr | 62 | 3.4 | 5.9 | — | 9.3 | 6 | 44 |
| | | Commercial PM Cold Work Tool Steels | | | | | | | |
| PM 8Cr4V | 89–19 | 1870° F./30 min, AC, 975 F./2 + 2 hr | 60 | 6.6 | 5.7 | — | 12.3 | 11 | 27 |
| PM M4 | 92–73 | 2125° F./4 min, OQ, 1050 F./2 + 2 + 2 hr | 62 | 3.8 | — | 8.8 | 12.6 | 31 | 29 |
| PM 12Cr4V | 90–136 | 2050° F./30 min/OQ, 500 F./2 + 2 hr | 59 | 3.0 | 20.0 | — | 23.0 | 8 | 20 |
| PM 10V | 95–154 | 2050° F./30 min/OQ, 1025 F./2 + 2 hr | 61 | 17.4 | — | — | 17.4 | 64 | 16 |
| PM 15V | 89–169 | 2150° F./30 min/OQ, 1025 F./2 + 2 + 2 hr | 62 | 22.7 | — | — | 22.7 | 77 | 8 |
| PM 18V | 89–182 | 2050° F./30 min/OQ, 1025 F./2 + 2 hr | 62 | 30.5 | — | — | 30.5 | 120 | 4 |
| | | Conventional Ingot-Cast Cold Work Tool Steels | | | | | | | |
| A-2 | — | not reported | 60 | — | 6 | — | 6*** | 2 | 40 |
| D-2 | — | not reported | 60 | — | 15.5 | — | 15.5*** | 3 | 16 |
| 85CrVMo | 85–65 | 1950° F./45 min, AC, 975 F./2 + 2 + 2 hr | 60 | 2.8 | 1.7 | — | 4.5 | 5 | 35 |
| 110CrVMo | 85–66 | 1950° F./45 min, AC, 1000 F./2 + 2 + 2 hr | 62 | — | — | — | — | 5 | 23.5 |
| D-7 | — | not reported | 61 | — | — | — | 24**** | 7 | 7 |

*Longitudinal test direction

**Minor amounts (<0.5%) of $M_7C_3$ primary carbides were detected by x-ray diffraction of carbides extracted from this steel by chemical dissolution methods.

***B. Hribernik, BHM 134, p. 338–341 (1989)

****K. Budinski, Wear of Materials, ASME, p. 100–109 (1977)

Hardness

Hardness can be used as a measure of a tool steel to resistant deformation during service in cold work applications. In general, a minimum hardness in the range of HRC is needed for tools in such applications. Higher hardnesses of 60–62 HRC afford somewhat better strength and wear resistance with some loss in toughness. The results of a hardening and tempering survey conducted on PM 3V (Bar 96-267) are given in Table III and clearly show that the PM cold work tool steel articles of the invention readily achieve a hardness in excess of 56 HRC when hardened and tempered over a wide range of conditions.

TABLE III

| | | Heat Treatment Response of PM 3V (Bar 96–267) | | | | | | | | | | | |
|---|---|---|---|---|---|---|---|---|---|---|---|---|---|
| | | Hardness (HRC) After Indicated Tempering Treatment | | | | | | | | | | | |
| | As | 950° F. | | 975° F. | | 1000° F. | | 1025° F. | | 1050° F. | | 1100° F. | |
| Austenitizing Temp. (° F.) | Oil Quenched | 2 × 2 hr | 3 × 2 hr | 2 × 2 hr | 3 × 2 hr | 2 × 2 hr | 3 × 2 hr | 2 × 2 hr | 3 × 2 hr | 2 × 2 hr | 3 × 2 hr | 3 × 2 hr | 3 × 2 hr |
| 1875 | 58 | 58 | 58 | 58 | 57.5 | 56.5 | 56 | 55 | 54.5 | 53 | 51.5 | 46.5 | 44 |
| 1950 | 62 | 61 | 61 | 60.5 | 60 | 60 | 59 | 58 | 57.5 | 55.5 | 54 | 49 | 47 |
| 2050 | 63.5 | 63 | 63 | 63 | 63 | 62 | 61.5 | 60.5 | 60.5 | 58.5 | 57 | 52.5 | 50.5 |

Impact Toughness

To evaluate and compare the impact toughness of the articles of the invention, Charpy C-notch impact tests were conducted at room temperature on heat treated specimens having a notch radius of 0.5 inch. This type of specimen facilitates comparative notch impact testing of highly-alloyed and heat treated tool steels that are normally expected to exhibit low V-notch toughness values. Results obtained for specimens prepared from three different PM articles made within the scope of the invention and for several commercial wear resistant alloys are given in Table II. They show that the impact toughness of the articles of the invention is clearly superior to those of all the other conventional ingot-cast and PM cold work tool steels that were tested for comparison.

An important aspect of the invention is illustrated in FIG. 3 which shows the Charpy C-notch impact test results versus total carbide volume for the PM tool steels that were heat treated to 60–62 HRC, as well as test results obtained for several conventionally produced tool steels at about the same hardness. The results show that the toughness of the PM tool steels decreases as the total carbide volume increases, essentially independent of carbide type.

In this regard, the PM 3V material (Bar 90-80), which is within the scope of the invention, has substantially only MC-type vanadium-rich primary carbides within the range of 4 to 8 percent by volume. The wear resistance of this material, in accordance with the invention, is identical to that of alloy PM 110CvVMo (Bar 91-65), which is outside the scope of the invention, and which has a significantly greater primary carbide volume. This demonstrates that the alloy of the invention is able to achieve identical wear resistance to that of the alloy outside the scope of the invention, having almost twice the volume of primary carbide. Moreover, the invention alloy unexpectedly has drastically improved impact toughness over that of the PM 110CvVMo alloy.

Specifically, the invention alloy has a C-notch Charpy impact strength of 54 ft-lbs compared to 44 ft-lbs for the noninvention alloy. These data clearly demonstrate that in accordance with the invention, one is able to achieve a combination of wear resistance and impact toughness heretofore unobtainable. In alloys PM 10V, PM 15V, and PM 18V, which similar to the alloy of the invention contain only MC-type carbides but at a volume level substantially above that of the invention alloy, impact toughness is drastically reduced over that achieved in accordance with the invention. Hence, to achieve the results of the invention, not only must the primary carbides be MC-type carbides, but the volume thereof must be within the limits of the invention, e.g., 4 to 8 percent by volume.

Metal to Metal Wear Resistance

The metal to metal wear resistance of the experimental materials was measured using an unlubricated crossed cylinder wear test similar to that described in ASTM G83.

In this test, a carbide cylinder is pressed and rotated against a perpendicularly oriented and stationary test sample at a specified load. The volume loss of the sample, which wears preferentially, is determined at regular intervals and used to calculate a wear resistance parameter based on the load and total sliding distance. The results of these tests are given in Table II.

FIG. 4 shows the metal to metal wear test results for the PM and conventionally produced cold work tool steels listed in Table I, plotted against total primary carbide content and the amount of MC-type carbide that they contain. Wear resistance as measured by this test increases dramatically as the volume percent of MC-type (vanadium-rich) primary carbide increases, which agrees well with actual field experience in metalworking operations. Although the PM articles of the invention, as represented by Alloy PM 3V (Bar 90-80) with 2.82% V, are somewhat less wear resistant than the PM materials containing 4% or more vanadium, they are still more wear resistant than A-2 or D-2 which contain less than 1% V. At the 4% V level, PM M4 performs significantly better than PM 8Cr4V and PM 12Cr4V in this test, despite having a total carbide volume comparable to PM 8Cr4V and about half that of PM 12Cr4V. The comparatively good wear resistance of PM M4 is attributed primarily to a combination of the approximately 4% MC-type carbide and the 9% $M_6C$-type (W and Mo-rich) carbide, which is harder than $M_7C_3$-type (Cr-rich) carbide present in the other two 4% 1V materials. Although conventionally produced D-2 and D-7 also contain relatively high total carbide volumes, the relatively low MC-type carbide contents of these materials consistently results in significantly lower wear resistance numbers compared to PM 3V and the much higher vanadium PM 10V, PM 15V, and PM 18V materials with similar carbide volumes.

In summary, the results of the toughness and wear tests show that a remarkable improvement in the impact toughness of wear resistant, vanadium-containing, powder metallurgy cold work tool steel articles can be achieved by restricting the amount of primary carbide present in their microstructure and by controlling their composition and processing such that MC-type vanadium-rich carbides are substantially the only primary carbides remaining in the microstructure after hardening and tempering. The combination of good metal to metal wear resistance and high toughness afforded by the PM articles of the invention clearly exceeds that of many commonly used ingot cast cold work tool steels such as AISI A-2 and D-2. Also, the high toughness of the PM articles of the invention clearly exceeds that of many existing PM cold work tool steels, such as PM 8Cr4V, which offer slightly better metal to metal wear resistance but lack sufficient toughness for use in many applications. Consequently, the properties of the PM articles of the invention make them particularly useful in cutting tools (punches and dies), blanking and punching tools, shear blades for cutting light gage materials, and other cold work applications where very high toughness of the tooling materials is required for good tool performance.

The term MC-type carbide as used herein refers to vanadium-rich carbides characterized by a cubic crystal structure wherein "M" represents the carbide forming element vanadium, and small amounts of other elements such as molybdenum, chromium, and iron that may also be present in the carbide. The term also includes the vanadium-rich $M_4C_3$ carbide and variations known as carbonitrides wherein some of the carbon is replaced by nitrogen.

The term $M_7C_3$-type carbide as used herein refers to chromium-rich carbides characterized by a hexagonal crystal structure wherein "M" represents the carbide forming element chromium and smaller amounts of other elements such as vanadium, molybdenum, and iron that may also be in the carbide. The term also includes variations thereof known as carbonitrides wherein some of the carbon is replaced by nitrogen.

The term $M_6C$ carbide as used herein means a tungsten or molybdenum rich carbide having a face-centered cubic lattice; this carbide may also contain moderate amounts of Cr, V, and Co.

The term "substantially all" as used herein means that there may be a small volume fraction (<1.0%) of primary carbides present other than MC-type vanadium-rich carbide without adversely affecting the beneficial properties of the articles of the invention, namely toughness and wear resistance.

All percentages are in weight percent unless otherwise indicated.

What is claimed is:

1. A method for producing a fully dense, wear resistant, vanadium-rich powder metallurgy cold work tool steel article with high impact resistance, said tool steel article consisting essentially of 0.60 to 0.95% carbon; 0.10 to 2.0% manganese; up to 0.10% phosphorus; up to 0.15% sulfur; 2.0% silicon max; 6.00 to 9.00% chromium; up to 3.0% molybdenum; up to 1.0% tungsten; 2.00 to 3.20% vanadium; up to 0.15% nitrogen; iron, and incidental impurities, wherein the maximum carbon content does not exceed that given by the following formula:

$$(\%\ C)_{maximum}=0.60+0.177(\%\ V-1.0),$$

said method comprising nitrogen atomizing a molten tool steel alloy at a temperature between 2800 and 3000° F. to produce powder, rapidly cooling the powder to ambient temperature, screening the powder to about −16 mesh (U.S. standard), hot isostatically compacting the powder at a temperature between 2000 and 2150° F. at a pressure between 13 and 16 ksi, whereby the resulting article is capable of being hot worked, annealed, and hardened to at least 58 HRC and having a volume fraction of substantially all MC-type vanadium-rich carbides between 4 and 8%, where the maximum sizes of the primary carbides do not exceed about six microns in their largest dimension and whereby a Charpy C-notch impact strength, as described herein, of at least 50 ft-lb is achieved.

2. The method of claim 1, wherein said fully dense, wear resistant, vanadium-rich powder metallurgy cold work tool steel article consists essentially of 0.70 to 0.90% carbon; 0.2 to 1.00% manganese; up to 0.05% phosphorus; up to 0.03% sulfur; 1.50% silicon max; 7.00 to 8.50% chromium; 0.50 to 1.75% molybdenum; up to 0.50% tungsten; 2.25 to 2.90% vanadium; up to 0.10% nitrogen; iron, and incidental impurities, wherein the maximum allowable carbon content does not exceed that given by the following formula:

$$(\%\ C)_{maximum}=0.60+0.177(\%\ V-1.0).$$

3. The method of claims 1 or 2, wherein said atomizing is conducted at a temperature between 2850 and 2950° F.

* * * * *